United States Patent [19]

Gruber

[11] Patent Number: 5,044,832

[45] Date of Patent: Sep. 3, 1991

[54] METHOD OF AND ARRANGEMENT FOR SETTING ANCHORS IN LOOSE ROCK RANGING FROM COHESION-POOR TO NON-COHESION ROCKS

[75] Inventor: Heinz Gruber, Seesen/Rhüden, Fed. Rep. of Germany

[73] Assignee: GD-Anker GmbH, Seesen/Rüden, Fed. Rep. of Germany

[21] Appl. No.: 443,121

[22] Filed: Nov. 29, 1989

[30] Foreign Application Priority Data

Nov. 29, 1988 [DE] Fed. Rep. of Germany ..... 3840158

[51] Int. Cl.[5] ..... E21D 20/02; E21D 21/00

[52] U.S. Cl. ..... 405/260; 405/236; 405/258

[58] Field of Search ..... 405/233, 232, 258, 236, 405/240-243, 260, 244, 248, 266, 263; 299/86; 175/394, 331, 332

[56] References Cited

U.S. PATENT DOCUMENTS

| | | | |
|---|---|---|---|
| 972,969 | 10/1910 | Wittich | 175/331 X |
| 2,229,912 | 1/1941 | Baily | 405/266 |
| 2,782,605 | 2/1957 | Wertz et al. | 405/266 |
| 3,494,133 | 2/1970 | Ahlgren et al. | 405/260 |
| 3,875,751 | 4/1975 | Paus | 405/263 |
| 4,046,205 | 9/1977 | Asayama | 405/244 X |
| 4,533,279 | 8/1985 | Elzen et al. | 405/233 X |

*Primary Examiner*—Dennis L. Taylor
*Attorney, Agent, or Firm*—Michael J. Striker

[57] ABSTRACT

During setting of anchors in loose rocks ranging from cohesion-poor to non-cohesion rocks, an anchor including a drilling rod and a drilling crown is used, in which the drilling rod is provided with a central axial opening and with radial opening in the region to the drilling crown to supply a mortar suspension or the like through the central axial opening during the drilling process.

10 Claims, 4 Drawing Sheets

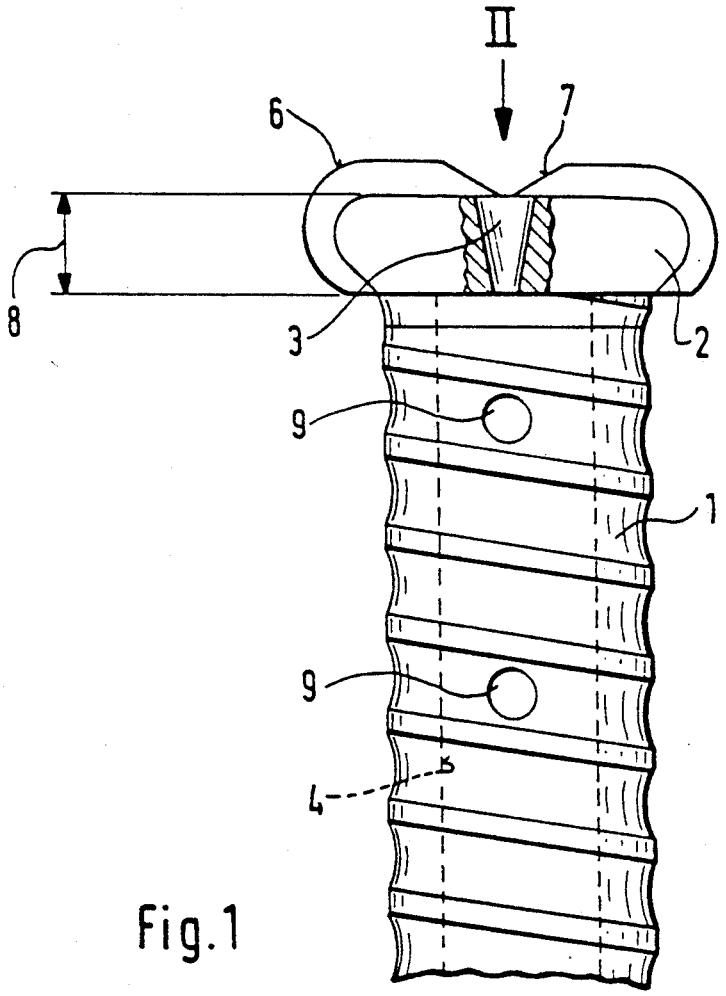
Fig.1
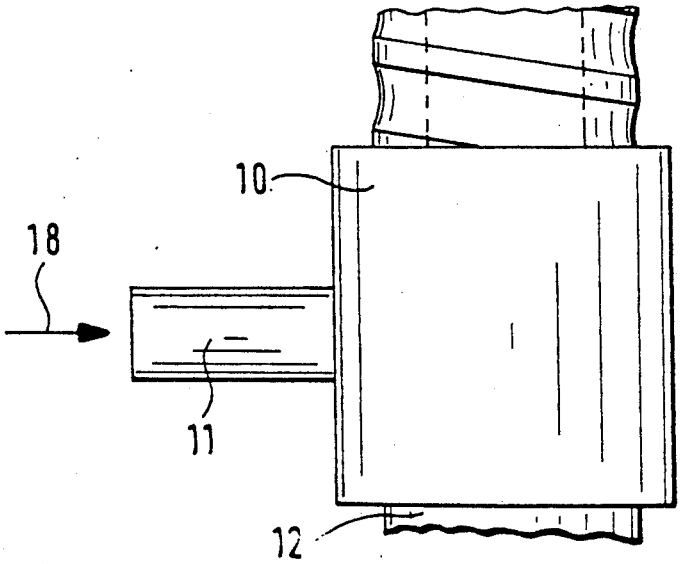

Fig. 2
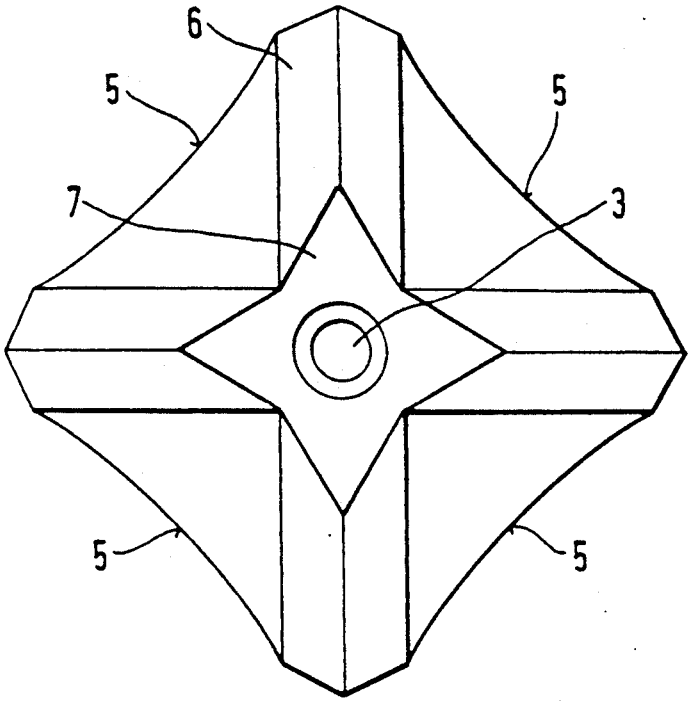
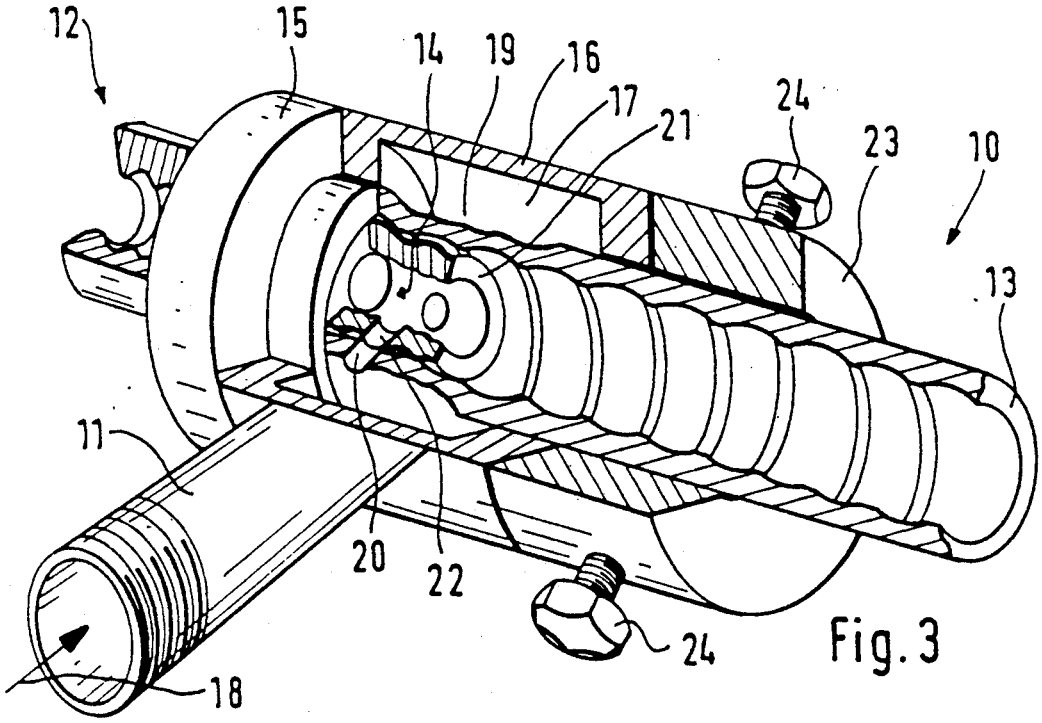
Fig. 3

METHOD OF AND ARRANGEMENT FOR SETTING ANCHORS IN LOOSE ROCK RANGING FROM COHESION-POOR TO NON-COHESION ROCKS

BACKGROUND OF THE INVENTION

Setting of anchors in rocks ranging from friable or cohesion-poor rocks to non-cohesion rocks for stabilizing of walls requires special steps for obtaining a stable position of the anchor. During the formation of a bore hole in such rocks, the problems arise in that the walls must be stabilized for preventing their collapse after withdrawal of a drilling rod. It is known to drill in these cases with casings and to compress the bore holes with cement mortar with simultaneous withdrawal of the tube. In this method the injected cement mortar also penetrates into the immediate surrounding area of the bore hole. The hardened bore hole filling is then again drilled and an anchor is inserted in the thusly produced opening and fixed with cement mortar. With this procedure it is possible to set the anchors in the above mentioned types of rock; however, this can be done with a relatively high time consumption and costs.

Rock anchors are also known which are simultaneously used as drilling rods and therefore include a tubular base body provided with a drilling crown at its front end. The above mentioned base body is profiled for producing a binding action with a mortar casing and has a plurality of openings in its peripheral region. During the drilling the rinsing medium, for example water, is supplied through the drilling crown and the above mentioned openings. Then after the end of the drilling, a mortar suspension is supplied into the produced bore hole. Under the above mentioned conditions, the sufficient penetration of the cement mortar in the rock surrounding the bore hole is not achieved in many cases, and thereby an insufficient adhesion of the anchor is produced.

A similar problem arises in many cases during production of pile foundations composed of individual piles provided with anchors. When for example an alternating sequence of cohesion-poor or non-cohesion layers on the one hand, and relatively solid layers on the other hand occurs along a path corresponding to the length of the pile, special steps must be taken to insure that the pile over its entire length has an average cross-section sufficient for the static carrying capacity of the respective pile foundation. In this case it is impossible to produce an opening which subsequently is filled with concrete, since the cross-section of the opening in the region of the soil layer is always provided with narrowings and the availability of the average cross-section over the whole length of the pile cannot be guaranteed in addition to the above mentioned narrowings.

In the latter mentioned case there is of course the possibility of an encased drilling, to insure the required uniform cross-section, especially maintaining an average cross-section.

The above mentioned known processes are either very labor and cost intensive and require therefore an expensive machinery, or can be used only to a limited extent with respect to the coherence of the respective rocks.

SUMMARY OF THE INVENTION

Accordingly, it is an object of the present invention to provide a method of and an arrangement for setting anchors in rocks of the above mentioned general type which avoid the disadvantages of the prior art.

More particularly, it is an object of the present invention to provide a method of and an arrangement for setting anchors which insure a reliable and stable positioning of anchors with substantially standardized available tools or structural elements in the above mentioned complicated conditions pertaining to partially cohesion-poor or non-cohesion rocks.

In keeping with these objects and with others which will become apparent hereinafter, one feature of the present invention resides, briefly stated, in a method in accordance with which during the drilling a mortar suspension or the like is supplied through the central opening of the drilling rod provided with radial openings in the region close to the drilling crown.

In accordance with the invention, a known injection drilling anchor can be used which, however, is provided at its front region close to the drilling crown with outlet openings through which as well as through the central rinsing opening a mortar suspension or a similar medium can be supplied during the drilling. Directly during the drilling process and in particular synchronously with advancement of the drilling, the rock surrounding the bore hole is compressed with a mortar suspension so that respective steps for stabilization of a bore hole wall are dispensed with. Since during this procedure smaller particles released during drilling are washed away by the mortar suspension, a high volume mixture including coarser released particles and mortar suspension is formed in the surrounding area of the drilling rod. In this manner a relatively deep penetration of the rock surrounding the bore hole and thereby a reliable securing or fixing of the anchor is obtained. A further advantage is achieved in the gap-free and therefore reliable encasing of the rock anchor with a mortar suspension. Thereby a reliable corrosion protection is obtained in the alkaline atmosphere produced in the immediate surrounding area of the anchor.

A further advantage of the method, both for setting of rock anchors and forming ground piles for foundations is a one-stage process, since in the same working process a quasi drilling and pre-cementing is performed. Therefore a preliminary making a hole is dispensed with.

In accordance with a further feature of the present invention, the process is performed so that relatively fine portions of the loosened material are washed away and relatively coarse portions of the loosened material are rinsed with the mortar suspension and bound with the latter during hardening. The outer diameter of the casing produced from the mortar and surrounding the anchor is controlled at a predetermined supply pressure of the mortar suspension by varying of the speed of drilling. Since the above mentioned washing out effect at a predetermined supply pressure of the mortar suspension is laterally expanded due to the low mechanical stability of the rock surrounding the opening, the radial dimensions of the mortar encasing of the anchor can be easily controlled by the drilling speed and thereby the drilling advancement. This opens simple possibilities for adjusting to different types of rock.

A further feature of the present invention is the arrangement for anchoring which includes the above mentioned anchor with a drilling rod and a drilling crown, wherein the drilling rod has a central axial opening and radial openings for simultaneously supplying the mortar suspension through the central opening during drilling. At the end of the drilling rod facing away of the drilling crown, the drilling rod is provided with an adaptor which is used for rotary drive and for supply of the mortar suspension.

In accordance with a further feature of the present invention, the adaptor has a bush for receiving an end of the drilling rod and transporting a torque, and a stationary housing for supplying a mortar suspension. The bush can have openings in the region of the housing and abutment means for the drilling rod inside. The housing can form a ring chamber surrounding the bush and fixed between immovable and detachable abutment members. With this feature the adaptor has an especially simple and advantageous design. It is composed of a few basic elements which are easily accessible for maintenance and inspection.

The drilling crown can have a tubular projection, a freely rotatable tearing tool, and a support for the tearing tool which can include side webs. Such a drilling crown is advantageous for erecting off ground piles in soils with an alternating sequence of cohesion-poor and solid layers. Since the side webs which laterally extend from the projection form a support for the freely rotatable tearing tool, there is a possibility to select the radial dimensions of this arrangement so that an opening formed in the ground has an average cross-section over its entire length, in which the tearing tool is effective and in which in each case a penetration of released material and mortar suspension is insured. For static computations a definite concrete cross-section can be taken into consideration whose radial dimensions are practically determined by the respective radial dimensions of the side webs in connection with the tearing tools mounted on them. Thereby in these relatively difficult cases, a single working step can be used both for producing the opening and for compressing the mortar to form a reinforced ground pile over a definite depth and, corresponding to the radial dimensions of the drilling crown, having definite radial dimensions, said dimensions—as seen over the whole length of the pile —do not fall below the dimensions of an average cross-section corresponding roughly to the radial dimensions of the drilling crown.

In accordance with a further feature of the present invention, side webs can be arranged in a plane extending through the axis of the projection. The side webs can be straight and have a square or a rectangular cross-section. They can be helically wound in the rotary direction of the drilling rod, for example about their longitudinal axes. They can extend from the drilling crown rearwardly at an angle relative to the axis of the projection in an arrow-like shape.

When the side webs are formed in accordance with these features, they are also suitable as a transporting element for displacing the forwardly released material to the rear side of the drilling crown. When the side webs are helically wound in the rotary direction of the drilling drive of the drilling rod and in some cases surround their longitudinal axes, the movement of the side webs in the mixture composed of the mortar suspension and the released material leads to a transporting action in direction toward the rear end of the drilling crown. The arrow-shaped extension of the side webs from the front side of the drilling crown facilitates the penetration during the rotary drilling. It should be emphasized that both a rotary and impact drilling can be performed as well.

In accordance with a further feature of the present invention, the drilling crown has a plurality of outlet openings for the mortar suspension supplied through the drilling rod. The exact location of these outlet openings is arbitrary. They serve particularly for escaping of the mortar in such a region in which during the rotary drilling the tearing tool rotatable opposite to the drilling drive is efficient. The tearing tool performs the functions of the mixing elements for making a mixture of released coarse-grain material with mortar suspension. Under the action of the rotatable tearing tool, a substantially homogenous mixture of mortar suspension and released material is produced in the region of the drilling crown. It is displaced by the displacing action of the side webs in connection with the tearing tool towards the rear side of the drilling crown.

The tearing tools can be arranged so that their axes are perpendicular to the side webs, and they can be provided with uniformly distributed cutting members. The cutting members or edges can be composed of a hard metal and dimensioned so that their effective region is confined inside the mixture to be mixed.

The tearing tools can be arranged so that they cover at most 50% of the surface of the bore hole produced during drilling. Therefore, despite the rotatable drilling crown a sufficient flow cross-section is available in a region of flow of the released material toward the rear side of the drilling crown.

The lateral extension of the side webs can have a radius corresponding to such a radius which permit a penetration of the mortar suspension during setting a rock anchor or erecting a ground pile. The projection can be provided with an outer thread for screwing with a drilling rod, and the outer thread can be formed preferably as a round thread or other threads.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a side view of an arrangement for setting anchors in accordance with the present invention;

FIG. 2 is a view as seen in direction of the arrow II in FIG. 1;

FIG. 3 is a perspective view of an adaptor of the inventive arrangement in accordance with the present invention;

DESCRIPTION OF THE PREFERRED EMBODIMENTS

Figure 4:
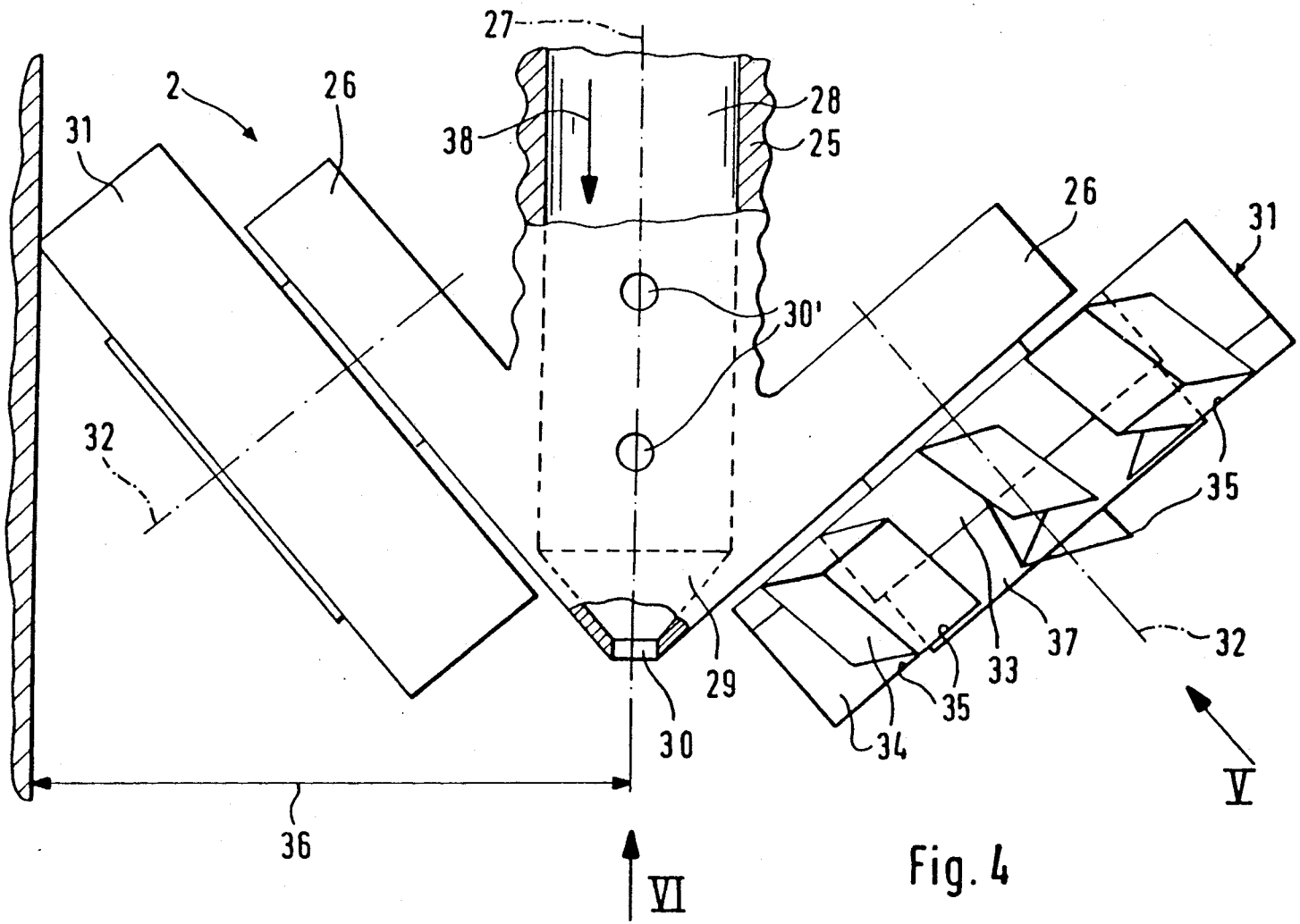
FIG. 4 is a side view of a drilling crown of the arrangement in accordance with the present invention.

A drilling rod in accordance with the present invention is identified as a whole with reference numeral 1. It is used simultaneously as an anchor, and more particularly both as a rock anchor for stabilization of the walls of the hollow spaces and also for piles serving for ground solidification. The drilling rod 1 is formed as a hollow cylindrical main body which is provided over its entire length with a thread-shaped formation in the shape of a round thread. Advantageously it is produced by a cold deformation, for example in cylinders or rollers.

The drilling rod 1 carries at its end a drilling crown 2 which is provided in a known manner with a central rinsing opening 3 extending coaxially to the drilling rod 1 or its central axial opening 4.

The drilling crown is formed as a plate-shaped, for example square main body, extending transversely to the axis of the drilling rod 1 and provided at its peripheral sides with cylindrical depressions 5. The depressions 5 have such sizes that their deepest points are in contact with an outer circle describing the outer thread. At its end facing toward the sole of the bore hole, the drilling crown carries prism-shaped projections 6 which have a star-shaped arrangement and serve as cutting edges. The projections 6 extend in direction toward the corners of the square main body. The projections 6 are formed around the lateral limiting edges of the above mentioned main body and end at a small distance from the points at which the drilling rod 1 is arranged. In this construction the projections 6 or the cutting edges are effective not only at the end side but also in the peripheral region. At the side of the bore hole sole the projection 6 ends in the central region of the main body in inclined surfaces 7 which are inclined in direction toward a mouth of the rinsing opening 3. In its axial direction, or in other words in direction of the arrow 8, the drilling crown 2 has as short size as possible. The connection between the drilling crown 2 and the drilling rod 1 is preferably formed releasable.

Since the drilling crown 2 is formed as short as possible in the direction of the arrow 8, the rock material released during the operation of the drilling rod in the end side region of the drilling head can be transported over a shortest path and also with minimum possible flow resistance to the side region of the drilling crown which faces away of the bore hole sole. Since the drilling crown 2 is releasbly mounted on the drilling rod 1, an exchange of the drilling crown for adjusting the drilling rod to different crown or rock properties or drill hole diameters is possible.

The drilling rod in its region adjacent to the drilling crown 2, or in other words extending from the drilling crown over a length of for example 0.5 m, is provided with openings 9. The central opening 4 of the drilling rod 1 communicates with the outside through these openings.

One or several extension portions are connected with the drilling rod 1 by not shown coupling parts. They correspond to the drilling rod 1 in their sizes and their other characteristics, however, are not provided with the openings 9.

The drilling rod 1 itself or the drilling rod extended in the above described manner is provided with an adaptor part 10 at its end facing away from the drilling crown 2. The adaptor part 10 is schematically shown in FIG. 3. It has a connecting portion 11 connected to a not shown conduit for anchoring mortar or a mortar suspension. A not shown coupling part for connecting a conventional drilling drive for drilling and/or impacting operation is provided at the point 12.

The adaptor part 10 as shown in FIG. 3 has a bush 13 with an inner thread corresponding to the outer thread of the drilling rod 1. The bush 13, as shown in the point 14, is inwardly closed and is again provided with an inner thread at 12. This inner thread forms a coupling member for a not shown drilling drive. An abutment body 15 is fixedly mounted on the outer surface of the bush 13, and its function will be explained hereinbelow. The bush 13 is surrounded by a stationary housing 16 which carries a connecting member 11 and which is provided with an inner annular chamber 17. The chamber 17 communicates in a not shown manner with the connecting member 11, so that the mortar suspension can be supplied through the connecting part 11 in direction of the arrow 18 into the annular chamber 17. A cylindrical recess 19 is formed in the outer surface of the bush 13 radially directly opposite to the annular chamber 17. The recess 19 is provided with a plurality of radial openings 20.

An impacting member 21 is screwed in the bush 13. In the shown embodiment it is formed as a relatively short tubular cylinder provided with an outer thread. It is inserted to the location 14 at which the inner chamber of the bush is closed. The impacting member 14 is provided with a plurality of radial openings 22, which are in alignment with the openings 20. Therefore, the annular chamber 17 and the inner chamber of the abutment member 21 communicate with one another for supplying the mortar suspension. The impacting member 21 insures that during screwing of the end of a drilling rod into the bush 13, the screwing-in depth of the drilling rod is limited and the drilling rod does not cover the openings 20. The housing part 16 which surrounds the bush 13 with a small play is held in its position abutting with a small play against the abutment body 15, by means of a further abutment body 23 which is axially movable relative to the bush 13. The abutment body 23 is arrested on the bush 13 by a plurality of clamping screws 24. In operation of the adaptor part 10, the housing 16 is immovably held between the abutment bodies 15 and 23 which are rotatable together with the bush.

The arrangement described in FIGS. 1–3 is used for setting rock anchors in friable rocks which range between rocks with low coherence to rocks with no coherence at all. In such situations during drilling instead of conventional rinsing means, a mortar suspension or cement dispersion is used, which is supplied through the connecting member 11 under pressure. During the drilling advance the mortar suspension flows both from the rinsing opening 3 of the drilling crown 2 and from the openings 9 of the drilling rod 1. A relatively fine grain material produced during the drilling process is washed away, while to the contrary the relatively coarse material remains in the bore hole and forms directly a mixture with the mortar suspension so as to harden at a later time, together with the latter. The mortar suspension required for producing a bond between the anchor on the one hand and the surrounding rock on the other hand, is introduced into the bore hole during the drilling process. Thereby not only the stabilization of the bore hole obtained directly during drilling, but also relatively large-space penetration of mortar suspension in the rock surrounding the bore hole is achieved. The last mentioned effect is further improved by the washing away of relatively fine-grain material. In the finally finished bore hole, the anchor is surrounded by a concrete-like casing which is composed of a mixture of mortar suspension and relatively coarse rock particles. Due to the large-volume penetration of the mortar suspension into the surrounding rock, a stabilization of the rock and a reliable mounting of the anchor is produced.

Figure 5:
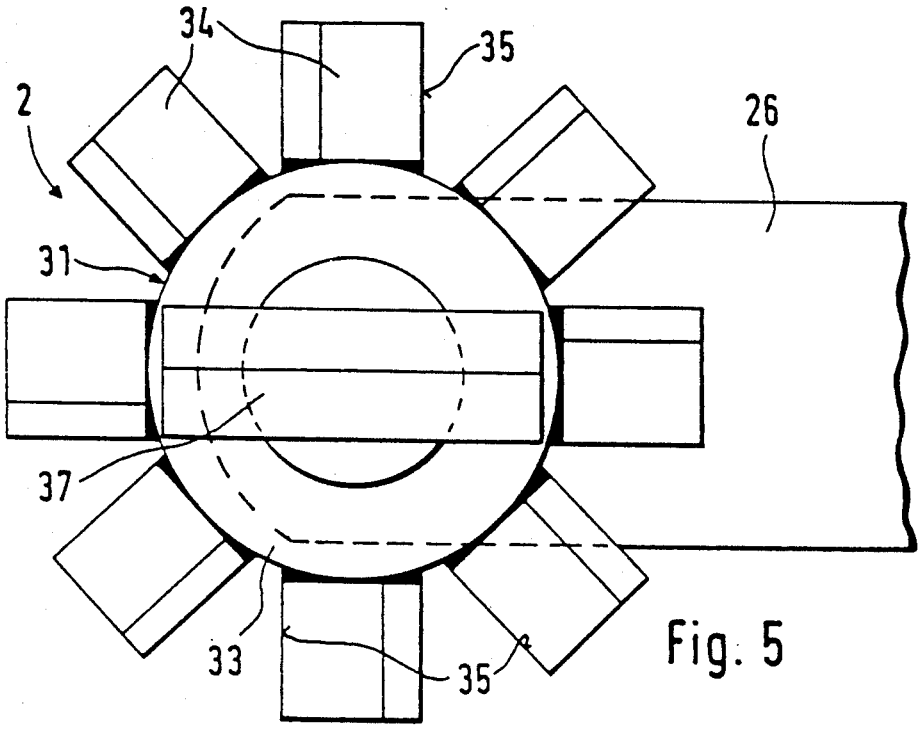
FIG. 5 is a view showing a detail of the drilling crown as seen in direction of the arrow V in FIG. 4.
Figure 6:
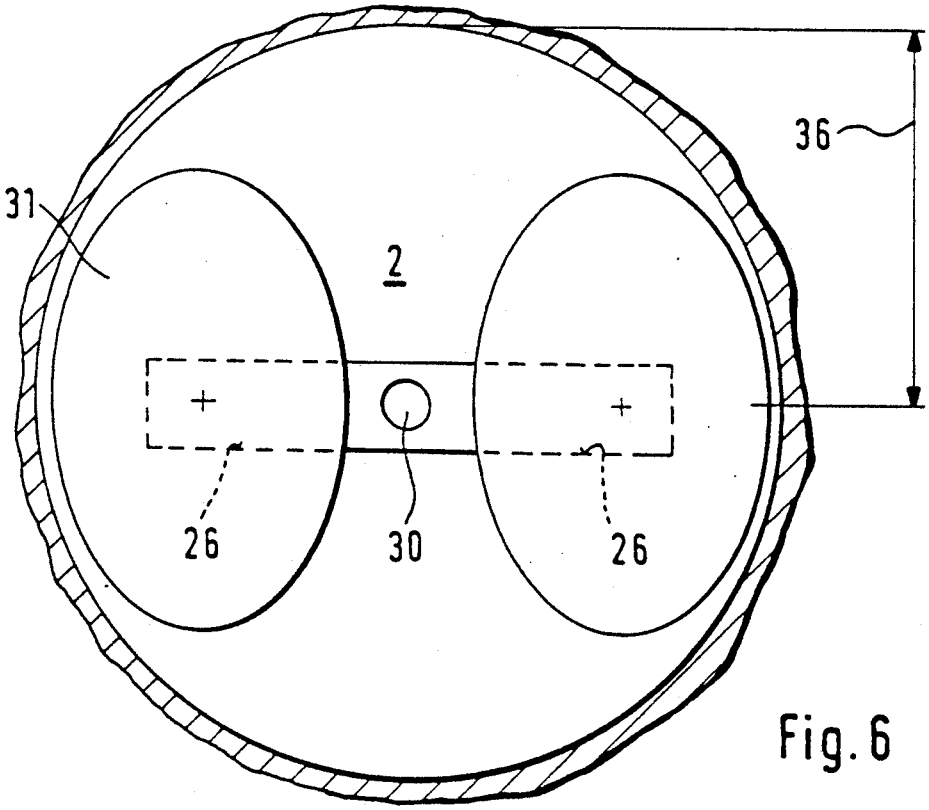
FIG. 6 is a view showing an end side of the drilling crown in the bore hole, in direction VI in FIG. 4.

FIGS. 4–6 show a drilling crown 2 which is designed for a predetermined application. This is the case in which an alternating sequence of layers of friable or non-coherent rock and relatively solid supporting layers are arranged in direction of the depth of a bore hole. The characteristic feature of this layer sequence is that in the region of the friable layers a collapse of the walls of the bore hole must be taken into consideration, while this does not occur in the region of the solid layers. For eliminating the disadvantages connected with the expected non-uniform cross-section of the bond system including the anchor and the surrounding mortar layer, a drilling head 2 described hereinbelow is proposed.

The drilling head 2 includes a tubular projection 25 which is provided outside with a relatively coarse thread, preferably a round thread. It has side webs 26 mounted on its front part facing toward the sole of the bore hole. The mounting can be performed in any manner, for example by welding with the outer wall of the projection 25.

The above mentioned side webs 26 extend in the shown embodiment substantially in a plane which includes the axis 27 of the projection 25. They extend from the projection 25 rearwardly in the shape of an arrow, or in other words, directed from the sole of the bore hole. In accordance with FIG. 4, they form an angle of approximately 45° with the axis 27 and can have for example a square cross-section as well as a rectangular cross-section.

The projection 25 is formed screwed by its thread with the drilling rod 1 formed in accordance with the embodiment of FIGS. 1–3. In the mounted condition of the drilling head 2, the axis 27 is coaxial to the central axial opening 4 of the drilling rod 1 in FIG. 1. The opening 28 of the projection 25, which forms the extension of the opening 4, ends in a portion 29 at its end facing toward the sole of the bore hole. The portion 29 has a conical end tip and is provided with a rinsing or outlet opening 30 at its end. The opening 30 is coaxial to the axis 27. The projection 25 is provided with further lateral outlet openings 30' which communicate with the opening 28.

Tearing tools formed a rotational bodies are identified with reference numeral 31. They extend perpendicularly to the side webs 26 and are freely rotatable around axes 32 lying in their plane. The tearing rools 31 are arranged on the side webs 26 at their sides facing toward the sole of the bore hole. The rotary support of the tearing tools 31 on the side webs 26 can be obtained in any desirable manner as long as the strength required for the drilling operation is ensured.

Each tearing tool 31 includes a rotation-symmetrical ring member 33 with a plurality of cutting members 34 arranged at its peripheral outer side. The cutting members 34 are preferably uniformly distributed over the periphery of the ring member 33. The cutting members 34 in the shown embodiment have a parallelepiped shape with projecting cutting edges 35 at their front side, or in other words, at their side facing toward the sole of the bore hole. It is to be understood that the remaining edges of the cutting body 34 also operate as cutting edges. The above described both tearing tools 31 are formed as identical elements with respect to one another.

The system composed of the side webs 26 and the tearing tools 31 has such dimensions that, as considered in an axial projection of FIG. 6, it occupies at most 50% of the surface with the radius 36, within which the tearing tools 31 provide a drilling or loosening action. As a result, during the drilling advance a sufficient cross-section in the region of the rotatable drilling head is available for transporting the torn, comminuted or loosened material to the rear side of the drilling head 2, or in other words to the side opposite to the sole of the bore hole.

A cutting member 37 extends on each tearing tool 31 over its ring member 32 at its side facing toward the sole of the bore hole. The cutting member 37 has an angular prismatic shape. It further contributes to the cutting, tearing and loosening action during the drilling advancement.

The utilization of the drilling head 2 of FIGS. 4–6 is substantially similar to the utilization of the above described drilling head. During producing of a bore hole, preferably with operation of an exclusively rotatable drilling head, a mortar suspension is directly supplied into the drilling rod, flows through the axial opening 4 into the opening 28 of the drilling head, and finally exits through the outlet openings 30, 30'. Due to the drilling process, the friable rock is loosened, fine or finest components are washed away, while the coarse components are mixed with the discharging mortar suspension to finally harden with the latter. The tearing tools which rotate during the rotary drilling opposite to the rotary direction of the drilling rod act for tearing the rock during the drilling advance, and also partially comminute the loosened coarse particles, especially a mixture of the loosened particles with the mortar suspension discharged through the openings 30, 30'. The tearing tools thereby simultaneously perform the function of mixing organs, so that during the drilling advancement a mixture of mortar suspension and coarse rock particles is formed behind the drilling crown 2, and the zone of the rock loosened by the drilling process or the bore hole remains constantly filled and no hollow spaces are formed. In the final condition, the anchor formed by the system of the drilling rod and drilling crow is bound on its whole length in the mortar impregnated with rock particles. In correspondence with the consistency of the surrounding rock as well as the introducing pressure of the mortar suspension, more or less deep penetration of the mortar suspension and the surrounding rock is achieved. The region of the rock or ground penetrated by the discharging mortar, which after hardening around the anchor forms a concreted, stabilized zone, has however an average cross-section which is independent from the layer sequence of the ground and is determined by the radius 36.

The latter means that, for example with the use of the process with reinforced pile foundations, the average cross-section of the pile is determined by the radius 36 depending on the construction of the drilling crown. This further means that with the given difficult conditions with alternating sequence of layers with different consistency, a ground pile can be set whose average cross-section is variable by structural dimensions of the above mentioned radius 36 in wide limits. The necessity of using a casing drilling is dispensed with, and a single working step is utilized for introducing the anchor into the ground or soil in a drilling manner and for compression of the mortar during drilling.

The above described drilling crown can be modified in various forms. In particular, any tearing tools rotatable about their axes can be used to perform simultaneously certain mixing action for the mixture of rock particles and mortar suspension. Moreover, the side webs 26 can be wound in a helical manner as seen in direction of the arrow VI, and also with respect to their longitudinal axes and their cross-section can have such a profile that a transporting action of the rock loosened by the tearing tools can be performed in direction of the sole of the bore hole.

It is possible to use more than two tearing tools 31, as long as a sufficient space for displacing the material loosened in the region of the bore hole sole is retained in the section torn by the radius 36. Also, instead of two side webs 26, more side webs can be provided as long as the above mentioned requirements are satisfied. useful application in other types of constructions differing from the types described above.

While the invention has been illustrated and described as embodied in a method of and an arrangement for setting anchors in loose rocks ranging from rocks with poor cohesion to rocks with no cohesion, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. An arrangement for anchoring in loose rocks ranging from cohesion-poor to non-cohesion rocks, comprising an anchor including a drilling crown and a drilling rod having a central axial opening and a plurality of radial openings in the region close to said drilling rod so that during drilling a liquid medium is simultaneously supplied through said central opening, said drilling rod having over its whole length a profiled outer surface formed as a round thread, said drilling crown including a tubular projection provided with means for tearing of rocks and mixing released material particles with mortar, said means in an axial view overlapping at least 50% of an area covered by the rock anchor during drilling, said projection being provided with an outer thread formed as a round thread for screwing said drilling rod, said projection being provided with a plurality of lateral openings and also with an axial opening at its front end formed so that said lateral openings and said axial opening communicate with said central axial opening of said drilling rod, said means extending laterally so that they cover a radius corresponding to a radius of a cross-section allowing a flow of the liquid medium during setting the rock anchor.

2. An arrangement as defined in claim 1, wherein said means at least one freely rotatable tearing tool arranged on said projection, said projection being provided with a support for said tearing tool, said support including two side flaps having front sides supporting said tearing tool.

3. An arrangement as defined in claim 2, wherein said projection has an axis, said side webs including at least two such side webs arranged in a plane which includes said axis.

4. An arrangement as defined in claim 2, wherein said side webs extend in a straight fashion and have a non-round cross-section selected from a square cross-section and a rectangular cross-section.

5. An arrangement as defined in claim 2 wherein said side webs are helically wound in a rotary direction of said drilling rod.

6. An arrangement as defined in claim 2, wherein each of said side webs has a longitudinal axis and is wound around said longitudinal axis.

7. An arrangement as defined in claim 2, wherein said projection has an axis, said side webs extending from a front end of said drilling crown rearwardly at an angle relative to said axis, said webs extending in an arrow-like manner.

8. An arrangement as defined in claim 2, wherein said tearing tools have axes extending perpendicular to said side webs.

9. An arrangement as defined in claim 2, wherein said tearing tools are provided with cutting members which are arranged in a uniform distribution.

10. An arrangement as defined in claim 1, wherein said drilling rod is provided with outlet openings in the region starting from said drilling crown over a length of substantially 0.5 m and communicating with said central axial opening.

* * * * *